US005819333A

United States Patent [19]

Coleman

[11] Patent Number: 5,819,333

[45] Date of Patent: Oct. 13, 1998

[54] PORTABLE, INFLATABLE, ONE-PERSON VESSEL FOR RECUMBENT, WEIGHTLESS, THERAPEUTIC FLOTATION

[76] Inventor: Jill Coleman, 10707 Sprinkle La., Owings Mills, Md. 21117

[21] Appl. No.: 789,208

[22] Filed: Jan. 24, 1997

[51] Int. Cl.[6] ..... A47K 3/02

[52] U.S. Cl. ..... 4/538; 4/575.1; 4/585

[58] Field of Search ..... 4/538, 575.1, 584, 4/585, 586, 588

[56] References Cited

U.S. PATENT DOCUMENTS

| | | | |
|---|---|---|---|
| 4,949 | 2/1847 | King . | |
| 133,276 | 11/1872 | Wheeler . | |
| 573,625 | 12/1896 | Ruffner . | |
| 736,089 | 8/1903 | Gray . | |
| 1,691,577 | 11/1928 | Lang . | |
| 2,471,302 | 5/1949 | Boward . | |
| 2,504,646 | 4/1950 | Burrow . | |
| 3,058,122 | 10/1962 | McDaniel et al. . | |
| 3,092,101 | 6/1963 | Kinney . | |
| 3,093,836 | 6/1963 | Christensen et al. . | |
| 3,373,451 | 3/1968 | Schmidt . | |
| 3,402,243 | 9/1968 | Gerow . | |
| 3,557,392 | 1/1971 | Schmidt . | |
| 3,630,193 | 12/1971 | Lancaster . | |
| 3,859,990 | 1/1975 | Simon . | |
| 4,068,326 | 1/1978 | Deschler | 4/588 |
| 4,074,370 | 2/1978 | Harmony, III . | |
| 4,152,792 | 5/1979 | Glintz . | |
| 4,312,084 | 1/1982 | Browning . | |
| 4,434,517 | 3/1984 | Dorris . | |
| 4,485,502 | 12/1984 | Marcanio . | |
| 4,547,919 | 10/1985 | Wang . | |
| 4,564,965 | 1/1986 | Goodwin . | |
| 4,637,083 | 1/1987 | Goodwin . | |
| 4,651,360 | 3/1987 | Wang | 4/588 |
| 4,754,502 | 7/1988 | Bowen . | |
| 4,785,486 | 11/1988 | Viesturs . | |
| 5,025,515 | 6/1991 | Rhines | 4/585 |
| 5,105,804 | 4/1992 | Nostrand . | |
| 5,247,712 | 9/1993 | Williams . | |
| 5,345,622 | 9/1994 | Plone . | |
| 5,406,653 | 4/1995 | Todor . | |
| 5,527,412 | 6/1996 | Hansen et al. | 4/538 |

*Primary Examiner*—David J. Walczak
*Attorney, Agent, or Firm*—Oblon, Spivak, McClelland, Maier & Neustadt, P.C.

[57] ABSTRACT

A portable, inflatable, one-person vessel for recumbent, weightless, therapeutic flotation of a sufferer features a plurality of substantially vertical inflatable compartments attached to a waterproof floor. Each of the inflatable compartments is interconnected in pneumatic communication with the other inflatable compartments. Each inflatable compartment is in contact with adjacent inflatable compartments. The portable, inflatable vessel can be erected around a person suffering from pathology such as back spasm, sciatic nerve pain, arthritis, etc., and who cannot or should not be moved, or for a person who does not have access to a therapeutic pool. The flotation vessel provides a weightless environment for relief of pain caused by weight of body, constriction of joints, pressure, muscle spasm or tension, nerve pain, and etc.

9 Claims, 1 Drawing Sheet

PORTABLE, INFLATABLE, ONE-PERSON VESSEL FOR RECUMBENT, WEIGHTLESS, THERAPEUTIC FLOTATION

This non-provisional application claims the priority of the earlier filed provisional application Ser. No. 60/022,700 filed Jul. 5, 1996.

BACKGROUND OF THE INVENTION

1. Field of the Invention

This invention concerns a therapeutic vessel which provides a sufferer with relief from pathology such as back spasm, sciatic nerve pain, arthritis, broken hip or osteoporosis, and etc. The invention more particularly concerns a therapeutic vessel which is portable, inflatable, and accommodates a single person in a recumbent position to provide a weightless, therapeutic flotation.

2. Discussion of the Background

Incapacitating back disability is a common complaint in men and women of all ages. The disability often strikes without warning in inconvenient places; and the sufferer cannot be moved. Even to lift the sufferer from the floor to bed may cause excruciating pain and may do irreparable harm. Many other physical conditions are equally incapacitating.

Therapeutic pools are increasingly recognized as beneficial, but very few people have access to them. Even with access, the sufferer is often prevented from getting to a therapeutic pool by the very incapacity from which the therapeutic pool would provide relief. In addition, some sufferers cannot swim, or are afraid to go into a therapeutic pool.

Prior art patents disclose portable, inflatable bathing devices. The prior art patents do not disclose the structure required to provide a portable, inflatable vessel for recumbent, weightless, therapeutic flotation of a sufferer.

Thus, there is a need to bring the relief of a therapeutic pool to the sufferer: at home, at the hospital, the therapist's office, the outdoors, or anywhere that it can be set up and filled with water to provide the soothing relief of weightlessness, and for gentle movement and exercise, increased circulation, and even physical therapy among other uses.

SUMMARY OF THE INVENTION

It is an object of the invention to provide a portable, inflatable vessel that replicates the weightlessness of a therapeutic pool in a minimum of water for home use. The new portable, inflatable vessel can be erected around a person who cannot get to a therapeutic pool, or who cannot be moved. The portable, inflatable vessel provides a weightless environment for relief of pain caused by weight of the body, constriction of joints, pressure, muscle spasm or tension, nerve pain, and etc. The portable, inflatable vessel allows for a full-body passive soaking of the patient.

In one form of the invention the portable, inflatable vessel takes the form of a plurality of substantially vertical inflatable compartments attached to a waterproof floor. Each inflatable compartment is inter-connected with adjacent inflatable compartments. The inter-connection between each adjacent vertical inflatable compartment is such that each vertical inflatable compartment is in pneumatic communication with the remaining vertical inflatable compartments. The inter-connected inflatable compartments create a continuous, self-enclosed wall which, together with an attached floor, defines the shape of the portable, inflatable vessel, and creates a watertight skin to contain the liquid.

A significant advantage of the present invention is the ability to use the device even during times of extremely restricted movement. The pain involved in movement necessary to accomplish even minimal tasks makes the present invention a major improvement over previous devices.

In another form of the invention the continuous, self-enclosed wall of the portable, inflatable vessel has horizontal dimensions that approximate the recumbent length and width of a person.

The present invention provides a portable, inflatable vessel that replicates the weightlessness of a therapeutic pool using a minimum amount of water for home use while overcoming prior art problems.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
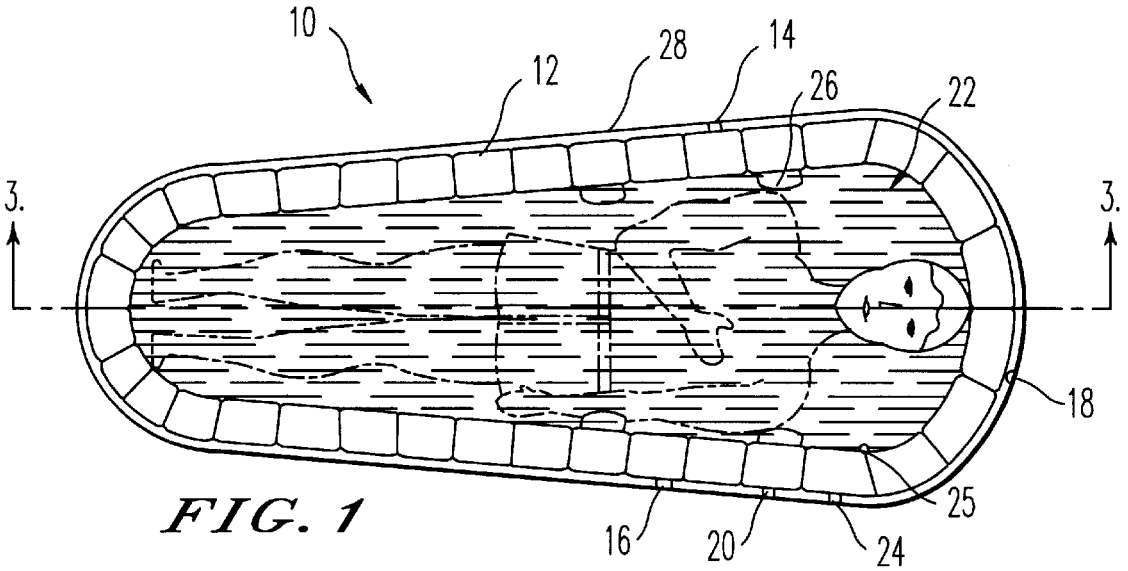
FIG. 1 is a top plan view of the portable, inflatable vessel showing a sufferer using the apparatus.

A portable, inflatable vessel has been created which replicates the weightlessness of a therapeutic pool using a minimum amount of water for home use. The embodiment of this invention is displayed in FIGS. 1, 2, and 3. FIG. 1 is a top plan view of the portable, inflatable vessel 10 showing the placement of each of the plurality of inflatable compartments 12, the water input valve 14, the water output valve 16, the water overflow valve 18, the inflatable compartment air inlet/exit valve 20, the bolster 22, the bolster air inlet/exit valve 24, the location of each safety handle 26, and the insulated jacket 28.

Figure 2:
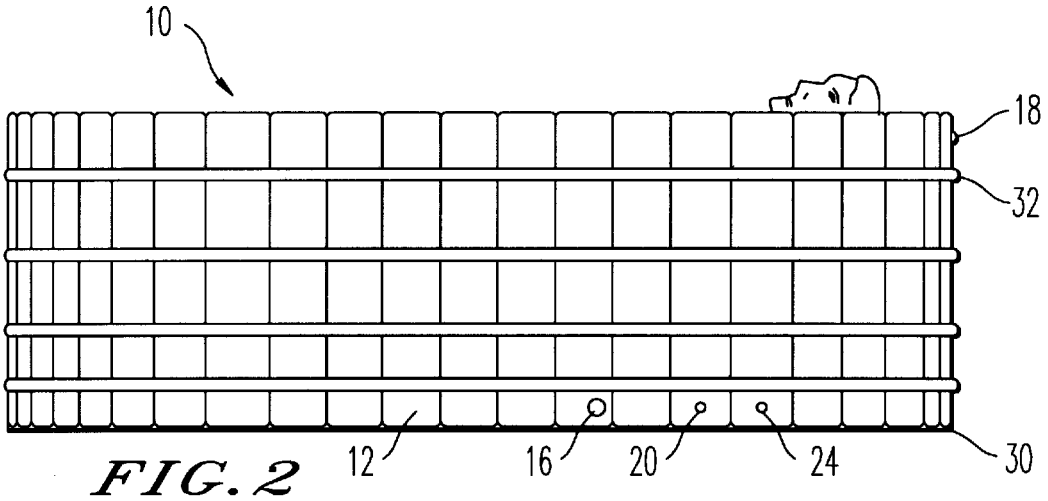
FIG. 2 is a side elevation view of the portable, inflatable vessel showing a sufferer using the apparatus.

FIG. 2 is a side elevation view of the portable, inflatable vessel with the insulated jacket 28 removed. With the insulated jacket 28 removed the waterproof floor 30 is revealed, along with the surrounding belts 32.

Figure 3:
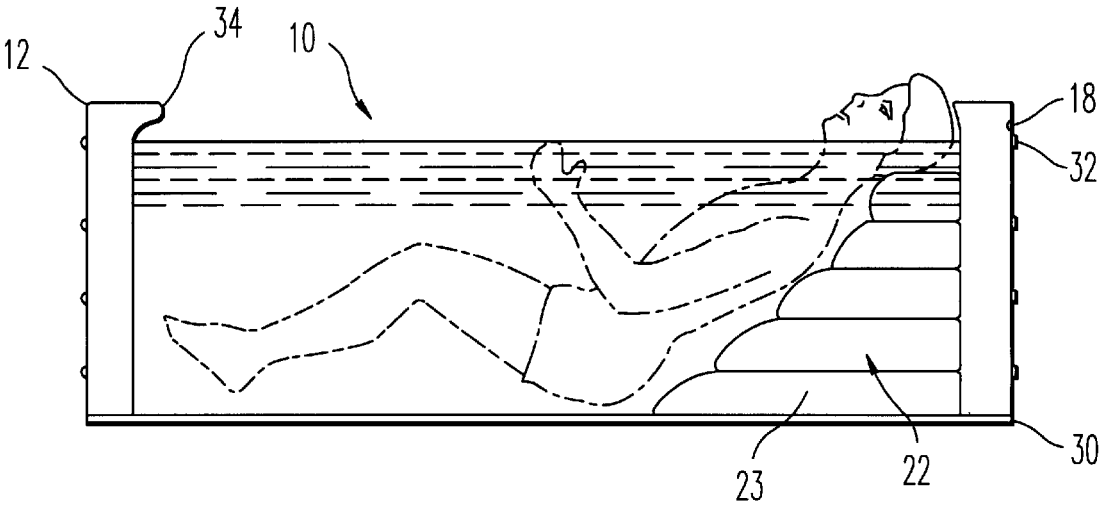
FIG. 3 is a cross sectional view taken along the line 3—3 of FIG. 1.

FIG. 3 is a cross section of the portable, inflatable vessel 10 taken along line 3—3 of FIG. 1. FIG. 3 further shows the placement of the bolster 22, and the inward lip 34 attached to the top end of each inflatable compartment 12. As in FIG. 2, the insulated jacket 28 is not shown in FIG. 3.

The portable, inflatable vessel 10 contains a waterproof floor 30. The waterproof floor 30 is made of a flexible, water-and-chemical-impervious skin. Attached to the substantially horizontal waterproof floor 30 are the bottoms of a plurality of substantially vertical, inflatable compartments 12. The plurality of substantially vertical, inflatable compartments 12 compose the sides of the portable, inflatable vessel 10. The plurality of substantially vertical, inflatable compartments 12 are in pneumatic communication with each other. Each inflatable compartment 12 is interconnected with adjacent inflatable compartments creating a continuous, self-enclosed wall, so that the therapeutic fluid does not leak between adjacent inflatable compartments 12. When the inflatable compartments are filled with air they become the sides, which support the portable, inflatable vessel. Each inflatable compartment 12 is constructed of a flexible, water-and-chemical-impervious skin.

Attached to one of the inflatable compartments 12 is a water input valve 14. The water input valve 14 allows water to pass through one inflatable compartment, without filling the inflatable compartment with water, flowing into the interior of the portable, inflatable vessel 10, filling the portable, inflatable vessel 10 with water. Connected to one of the other inflatable compartments 12 is a water output valve 16. The water output valve 16 allows water to exit the interior of the portable, inflatable vessel 10 without filling the inflatable compartments 12 with water. An overflow valve 18 is connected to one of the other inflatable compartments 12. The overflow valve 18 allows water of a certain height within the interior of the portable, inflatable vessel 10 to exit the interior of the portable, inflatable vessel 10 without filling the inflatable compartments 12 with water.

An air inlet/exit valve 20 is attached to one of the inflatable compartments 12. The air inlet/exit valve 20 allows air to enter and fill the plurality of inflatable compartments 12 which are in pneumatic communication with each other. The air inlet/exit valve 20 also allows air to exit the plurality of inflatable compartments 12.

The safety handles 26 are attached to inflatable compartments 12 in the interior of the portable, inflatable vessel 10 in locations where a sufferer is able to easily grasp the safety handles 26.

As shown in FIGS. 2 and 3, surrounding belts 32 can be placed around the exterior of the inflatable compartments 12, as necessary, to provide further structural strength. Additionally, FIG. 1 shows the use of an insulated jacket 28.

FIG. 3 displays the use of the inward lip 34 integrally molded with, and formed at the top of, each of the inflatable compartments 12. FIG. 3 further shows the use of the bolster 22. The bolster 22 is placed in the interior region of the portable, inflatable vessel 10. An air inlet/exit valve 24 is attached to one of the inflatable compartments 12 and passes through that inflatable compartment and is attached to the bolster 22 at fitting 25. The air inlet/exit valve 24 allows the bolster 22 to be filled with air or to have air exit the bolster 22, without filling the inflatable compartments 12 with air. The shape of the bolster 22 is formed by positioning a plurality of inter-connected horizontal air cavities 23 as shown in FIGS. 1 and 3. The plurality of inter-connected horizontal air cavities 23 function similarly as do the plurality of inflatable compartments 12.

The portable, inflatable vessel 10 can be erected around a sufferer who cannot get to a therapeutic pool, or who cannot be moved. The portable, inflatable vessel 10 can even be set up on the bed in which the sufferer is confined. Once the sufferer is placed on the waterproof floor 30, air may be introduced into the air inlet/exit valve 20 to inflate the inflatable compartments 12. Likewise, air may be introduced through the air inlet/exit valve 24 to fill the bolster 22 with air. The water output valve 16 is then closed, and water may be introduced through the water input valve 14 to fill the interior of the portable, inflatable vessel 10. The water supply can be connected to a separate heating element with a thermostat and controls. The insulated jacket 28 may be placed around the portable, inflatable vessel 10 to retain the heat of the water in the portable, inflatable vessel 10. Additionally, a waterproof cover can be fitted over the top of the portable, inflatable vessel 10 for purposes of privacy, heat retention, and splash minimization.

The portable, inflatable vessel 10 allows for full-body passive soaking of the occupant. The occupant can also use heated water and therapeutic agents such as Epsom salts or castor oil, which are not feasible in a therapeutic pool. The portable, inflatable vessel 10 will provide a weightless environment for mild therapeutic movement, stretching, chiropractic manipulation, and etc.

The inward lip 34 provided on each inflatable compartment 12 prevents the water from sloshing out of the interior of the portable inflatable vessel 10.

The safety handles 26, attached to the interior side walls of the inflatable compartments 12, provide the occupant with safety, security, and mobility within the portable inflatable vessel 10.

The vessel 10 is manufactured such that its collapsed bulk is only slightly greater than a hospital sheet. This is a significant benefit because many patients cannot position themselves to enter a structure which is more than a few inches high. With the present device, the care-taker places the collapsed device 10 aside the patient. Then the patient, retaining complete control of his movement in order to avoid further spasm, slides himself into the device by sliding over a side wall until he is positioned entirely on the floor 30. Only then is the device inflated and filled with water. This invention provides the necessary portability with inflatability to enable this procedure to be carried out by the patient.

To further enhance the safety and comfort of the portable inflatable vessel 10, the bolster 22 made of a plurality of inter-connected horizontal air cavities 23 is provided to comfortably support the head of the occupant, if needed, thus providing actual and perceived safety to the occupant. The bolster 22 occupies a maximum volume of the portable, inflatable vessel's interior, while still allowing the occupant to float freely. This design minimizes the volume of water necessary to achieve flotation of the almost submerged body, and therefore minimizes the total weight of the portable inflatable vessel 10, water, and occupant. As an example, a five foot long and on average one and one-quarter foot wide portable, inflatable vessel having a water depth of two feet surrounding an occupant would have a capacity of approximately twelve and one-half cubic feet. Such a vessel would provide weightless flotation to an occupant five feet, eight inches tall, and weighing one-hundred-thirty-five pounds. Assuming that body weight approximately equals the weight of water, total weight of water and body would be approximately seven-hundred-eighty-five pounds, in addition to the weight of the vessel. In all but the most extreme cases, this is less than the weight of a waterbed. Thus, the portable, inflatable vessel addresses the crucial factor of weight in consideration of the structural strength of the supporting surface, such as a floor, bed, or ground.

When the occupant has finished using the portable inflatable vessel 10 the water output valve 16 may be opened to drain water from the interior of the portable inflatable vessel 10. The inflatable compartment air inlet/exit valve 20 may be opened and the bolster air inlet/exit valve 24 may also be opened to empty all the air cavities either mechanically or manually. The portable inflatable vessel 10 may then be collapsed for storage or transportation.

The portable, inflatable vessel 10 can, if necessary, be used as a container for moving or lifting the occupant.

The horizontal dimensions of the interior of the portable, inflatable vessel 10 approximate the recumbent length of the body, and the recumbent width of the body at various intervals of its length. The vertical dimension is sufficiently high to prevent overflow and to allow the body to float free of the waterproof floor 30.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A portable, inflatable, one-person vessel for recumbent, weightless, therapeutic flotation, comprising:

a plurality of substantially vertical inflatable compartments each having a top, a bottom, an exterior, and an interior side wall, each of said plurality of compartments being inter-connected with adjacent compartments creating one continuous, self-enclosed wall, and wherein each of said compartments is inflatable and is in pneumatic communication with the remaining compartments;

a waterproof floor connected to the bottoms of the plurality of substantially vertical inflatable compartments, creating an interior region of the vessel defined by the interior side walls of the plurality of substantially vertical inflatable compartments and the top of the waterproof floor;

a bolster situated in the interior of the portable, inflatable, vessel; and an air inlet/exit valve connected to one of the plurality of inflatable compartments, so that the air inlet/exit valve is in pneumatic communication with the bolster, without filling the plurality of inflatable compartments with air.

2. A portable, inflatable vessel as recited in claim 1, further comprising a water input valve attached to one of the inflatable compartments, whereby the interior region of the portable, inflatable vessel is filled with water, without filling the inflatable compartments with water.

3. A portable, inflatable vessel as recited in claim 1, further comprising a water output valve connected to one of the inflatable compartments, whereby water is drained from the interior region of the portable, inflatable vessel, without filling the inflatable compartments with water.

4. A portable, inflatable vessel as recited in claim 1, further comprising an overflow valve connected to one of the inflatable compartments so that the overflow valve is in fluidic communication with the interior region of the portable, inflatable vessel, so that water may flow out of the portable, inflatable vessel at a predetermined height without filling the inflatable compartments with water.

5. A portable, inflatable vessel as recited in claim 1, further comprising an inward lip formed at the top of each of said inflatable compartments to assist retention of water in the portable, inflatable vessel.

6. A portable, inflatable vessel as recited in claim 1, further comprising at least one safety handle attached to the interior side wall of one of the inflatable compartments.

7. A portable, inflatable vessel as recited in claim 1, further comprising an insulated jacket in contact with the exterior of the inflatable compartments.

8. A portable, inflatable vessel as recited in claim 1, further comprising at least one surrounding belt, surrounding the plurality of substantially vertical inflatable compartments.

9. A portable, inflatable vessel as recited in claim 1, further comprising an air inlet/exit valve attached to one of the inflatable compartments, so that the air inlet/exit valve is in pneumatic communication with the inflatable compartments.

* * * * *